US009902169B2

(12) United States Patent
Zengo et al.

(10) Patent No.: US 9,902,169 B2
(45) Date of Patent: Feb. 27, 2018

(54) DROPLETS DRYING DEVICE AND IMAGE FORMING APPARATUS

(71) Applicant: FUJI XEROX CO., LTD., Tokyo (JP)

(72) Inventors: Takeshi Zengo, Kanagawa (JP); Akira Sakamoto, Kanagawa (JP); Toshinobu Hamazaki, Kanagawa (JP); Jun Isozaki, Kanagawa (JP); Hiroyuki Tsukuni, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/338,533

(22) Filed: Oct. 31, 2016

(65) Prior Publication Data

US 2018/0001666 A1 Jan. 4, 2018

(30) Foreign Application Priority Data

Jun. 30, 2016 (JP) ..... 2016-130669

(51) Int. Cl.
*B41J 11/00* (2006.01)
*B41M 5/00* (2006.01)

(52) U.S. Cl.
CPC ..... *B41J 11/002* (2013.01); *B41M 5/0011* (2013.01)

(58) Field of Classification Search
CPC ..... B41J 2/01; B41J 29/393; B41J 11/002
See application file for complete search history.

(56) References Cited

U.S. PATENT DOCUMENTS

2004/0227801 A1* 11/2004 Kumamoto ..... B41J 11/002 347/102
2005/0190224 A1* 9/2005 Yokoyama ..... B41J 11/002 347/17
2007/0076079 A1 4/2007 Miura
2007/0077367 A1 4/2007 Miura
2014/0210880 A1* 7/2014 Edlitz ..... H05B 33/0851 347/5

FOREIGN PATENT DOCUMENTS

| | | |
|---|---|---|
| JP | 2007-111984 | 5/2007 |
| JP | 2007-125876 | 5/2007 |
| JP | 4400541 | 11/2009 |
| JP | 2013094979 A * | 5/2013 |

OTHER PUBLICATIONS

Abstract and machine translation of JP 2007-111984.

* cited by examiner

*Primary Examiner* — Kristal Feggins
*Assistant Examiner* — Kendrick Liu
(74) *Attorney, Agent, or Firm* — Fildes & Outland, P.C.

(57) ABSTRACT

A droplets drying device includes: a drying mechanism having a plurality of light sources that are arranged in a width direction of a recording medium, and dry droplets ejected onto the recording medium by emitting light toward the droplets; a moving mechanism that moves the drying mechanism in the width direction; a light shield member that is opposed to at least part of the drying mechanism being moved by the moving mechanism, and interrupts light emitted from the light sources disposed in the part, opposed to the light shield member, of the drying mechanism; and a measuring member that is disposed in a light shield region where the light shield member interrupts incoming light, and receives light emitted from each of the light sources and measures a light quantity of the light source as the measuring member is moved relative to the drying mechanism in the width direction.

19 Claims, 15 Drawing Sheets

DROPLETS DRYING DEVICE AND IMAGE FORMING APPARATUS

CROSS-REFERENCE TO RELATED APPLICATIONS

This application is based on and claims priority under 35 USC 119 from Japanese Patent Application No. 2016-130669 filed on Jun. 30, 2016.

BACKGROUND

Technical Field

The present invention relates to a droplets drying device and an image forming apparatus.

SUMMARY

According to an aspect of the invention, there is provided a droplets drying device comprising: a drying mechanism having plural light sources that are arranged in a width direction of a recording medium, and dry droplets ejected onto the recording medium by emitting light toward the droplets; a moving mechanism that moves the drying mechanism in the width direction; a light shield member that is opposed to at least part of the drying mechanism being moved by the moving mechanism, and interrupts light emitted from the light sources disposed in the part, opposed to the light shield member, of the drying mechanism; and a measuring member that is disposed in a light shield region where the light shield member interrupts incoming light, and receives light emitted from each of the light sources and measures a light quantity of the light source as the measuring member is moved relative to the drying mechanism in the width direction.

BRIEF DESCRIPTION OF THE DRAWINGS

Exemplary embodiments of the present invention will be described in detail based on the following figures, wherein.

DESCRIPTION OF SYMBOLS

Figure 1:
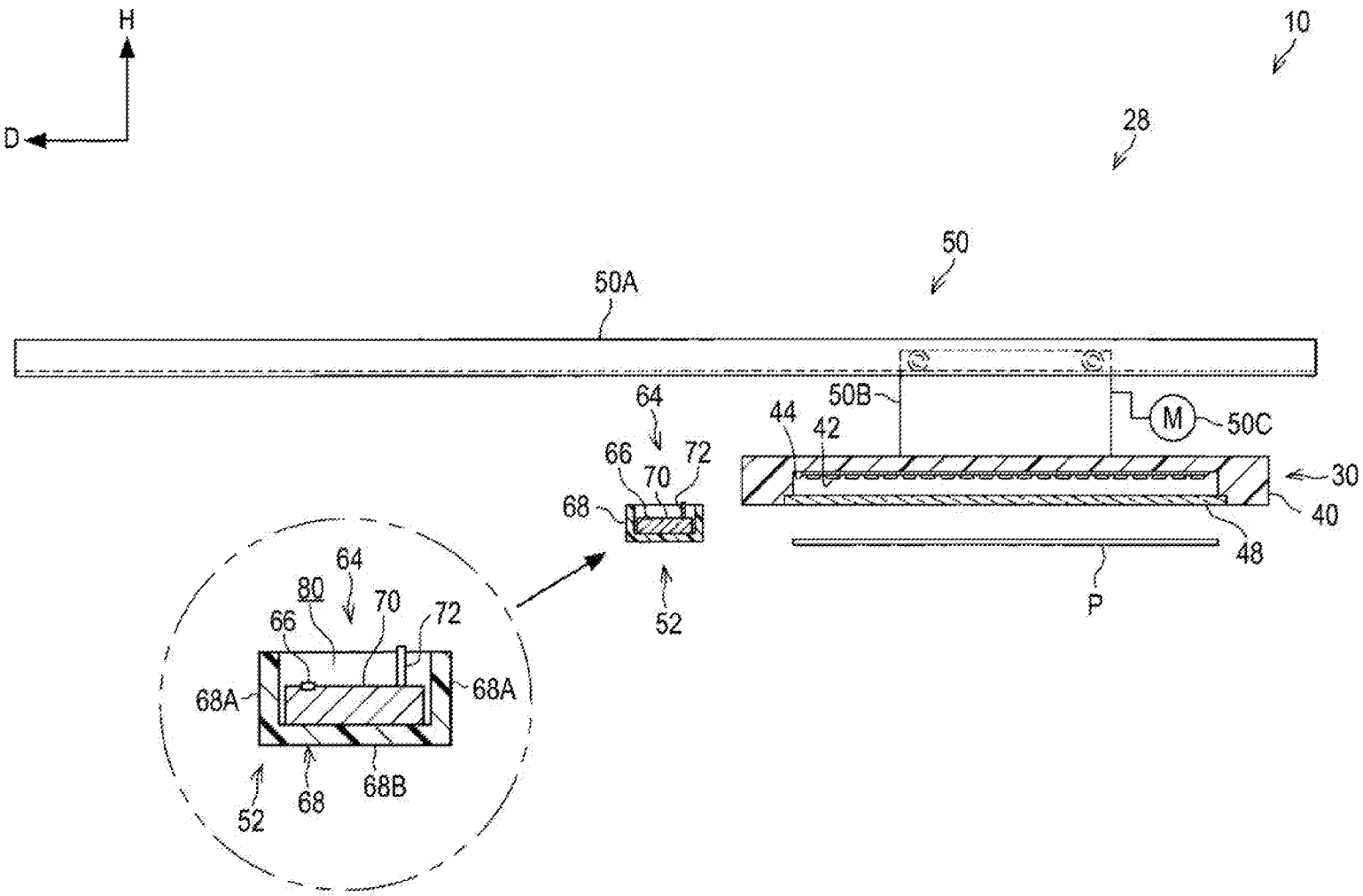
FIG. 1 is a sectional view of a droplets drying device according to a first exemplary embodiment of the present invention.

10: Image forming apparatus
24: Droplets ejecting head (example droplets ejecting member)
28: Droplets drying device
30: Drying unit (example drying mechanism)
42: Light source
48: Protective member
50: Moving mechanism
54: Controller (example correction unit)
64: Cleaning member
66: Measuring member
68: Body (example light shield member)
128: Droplets drying device
154: Controller (example correction unit)
164: Cleaning member
166: Measuring member
168: Body (example light shield member)

DETAILED DESCRIPTION

Exemplary Embodiment 1

Droplets drying devices 28 and an image forming apparatus 10 according to a first exemplary embodiment of the present invention will be described below with reference to FIGS. 1-10. Arrows H, W, and D in the figures indicate the apparatus top-bottom direction (vertical direction), the apparatus width direction (horizontal direction), and the apparatus depth direction (horizontal direction), respectively.

(Overall Configuration)

Figure 10:
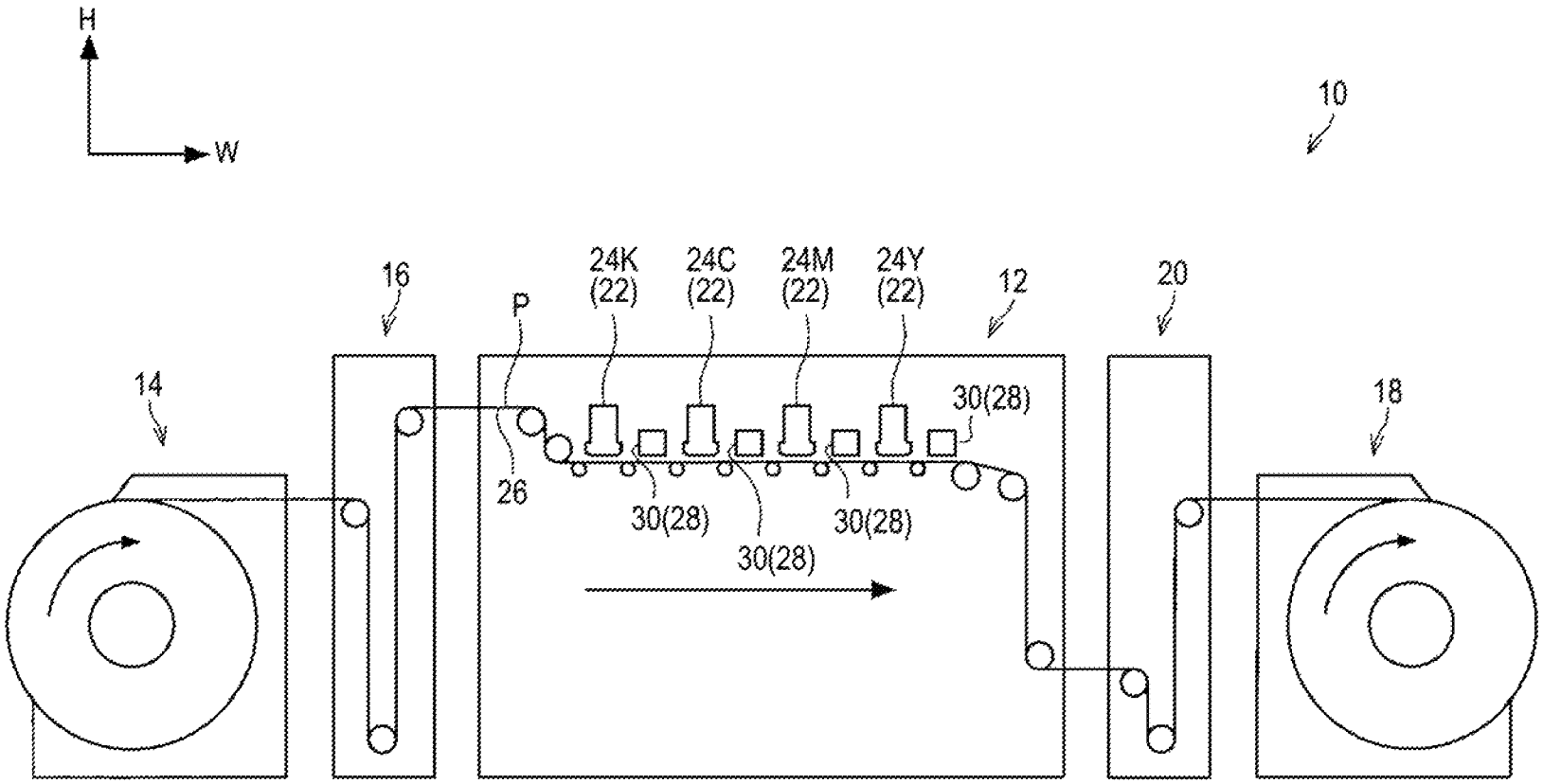
FIG. 10 is a schematic diagram showing the configuration of an image forming apparatus according to the first exemplary embodiment of the invention.

As shown in FIG. 10, the image forming apparatus 10 is equipped with an image forming unit 12 for forming an image on a portion of a continuous sheet P (recording medium), a preprocessing unit 14 which houses the continuous sheet P to be supplied to the image forming unit 12, and a buffer unit 16 which is disposed between the image forming unit 12 and the preprocessing unit 14 and adjusts the rate of conveyance of a portion, to be supplied from the preprocessing unit 14 to the image forming unit 12, of the continuous sheet P and other things.

The image forming apparatus 10 is further equipped with a post-processing unit 18 which houses part of the continuous sheet P put out of the image forming unit 12 and a buffer unit 20 which is disposed between the image forming unit 12 and the post-processing unit 18 and adjusts the rate of conveyance of a portion, to be put out of the image forming unit 12 to the post-processing unit 18, of the continuous sheet P and other things.

A droplets ejecting device 22 for forming an image on a portion, being conveyed along a conveyance path 26, of the continuous sheet P by ejecting droplets onto it and plural droplets drying devices 28 are disposed inside the image forming unit 12.

The droplets ejecting device 22 is equipped with a droplets ejecting head 24K which is an example droplets ejecting member for forming a K (black) image by ejecting droplets onto a portion of the continuous sheet P, a droplets ejecting head 24C which is an example droplets ejecting member for forming a C (cyan) image, a droplets ejecting head 24M which is an example droplets ejecting member for forming an M (magenta) image, and a droplets ejecting head 24Y which is an example droplets ejecting member for forming a Y (yellow) image.

The droplets ejecting heads 24K, 24C, 24M, and 24Y are arranged in this order downstream in the conveying direction of the continuous sheet P (hereinafter referred to simply as a "sheet conveying direction" so as to be opposed to a portion of the continuous sheet P. In the following description, characters K, Y, M, and C to be attached to reference numerals will be omitted if the colors K, Y, M, and C need not be discriminated from each other for components concerned.

The droplets drying devices 28 for drying droplets ejected onto a portion of the continuous sheet P by the droplets ejecting heads 24 are disposed downstream of the respective droplets ejecting heads 24K, 24C, 24M, and 24Y in the sheet conveying direction. The droplets drying devices 28 will be described below in detail.

(Configuration of Essential Part)

Next, the droplets drying devices 28 will be described. As shown in FIG. 10, the droplets drying devices 28 are disposed downstream of the respective droplets ejecting heads 24K, 24C, 24M, and 24Y in the sheet conveying direction. Since the droplets drying devices 28 have the same configuration, only one of them will be described below as a representative one.

As shown in FIG. 1, the droplets drying device 28 is equipped with a drying unit 30, a moving mechanism 50 for moving the drying unit 30, a maintenance unit 52 for maintaining the drying unit 30, and a controller 54 (see FIG. 9) for controlling the other individual units.

[Drying Unit 30]

The drying unit 30, which is an example drying mechanism, is disposed at a drying position (see FIG. 1) where it is opposed to a portion of the continuous sheet P or an escape position (see FIG. 4) where it is not. The escape position is spaced from the drying position in the apparatus depth direction. The movement of the drying unit 30 will be described later in detail.

Figure 5:
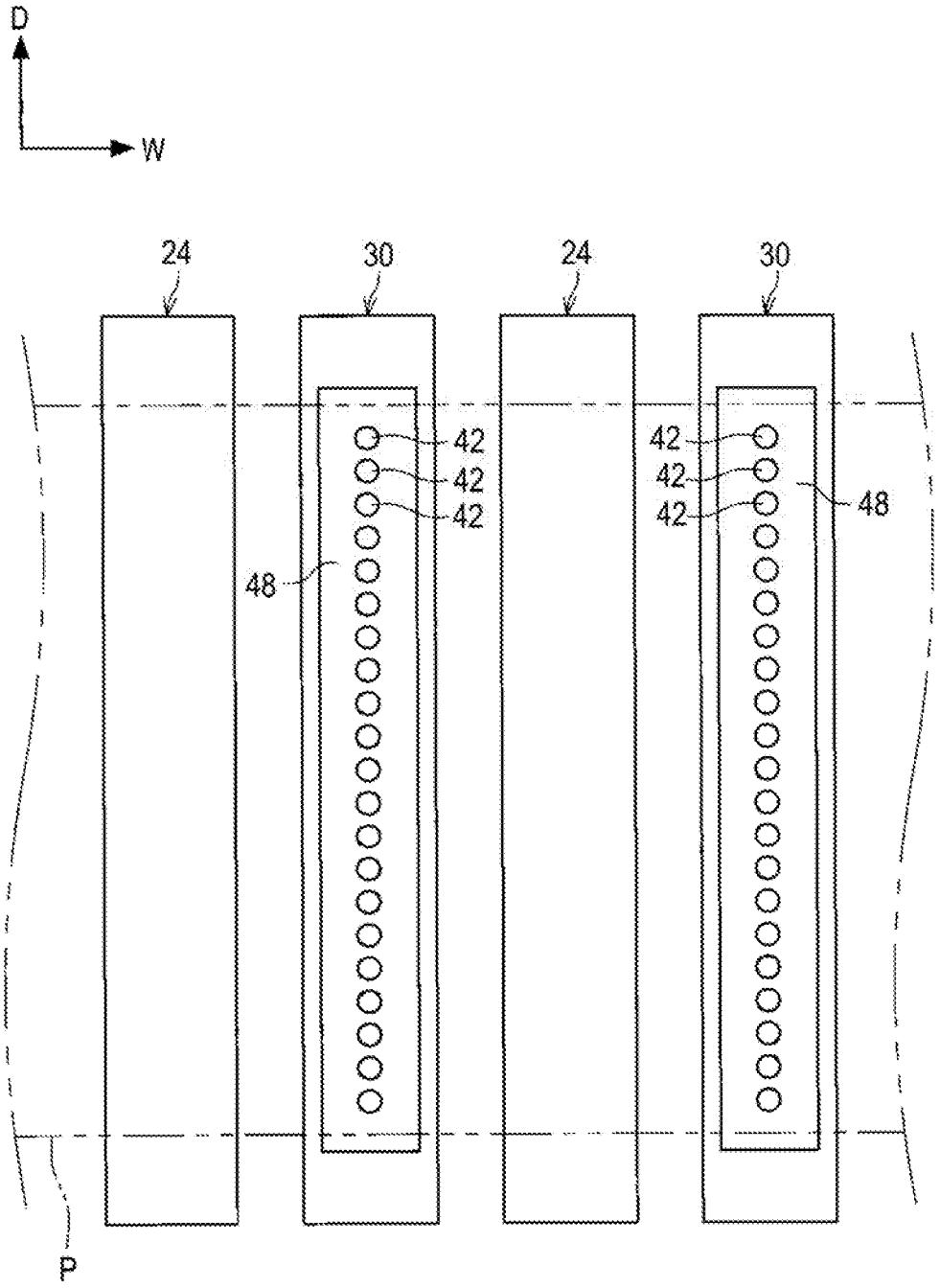
FIG. 5 is a plan view of the droplets drying device according to the first exemplary embodiment.
Figure 6A:
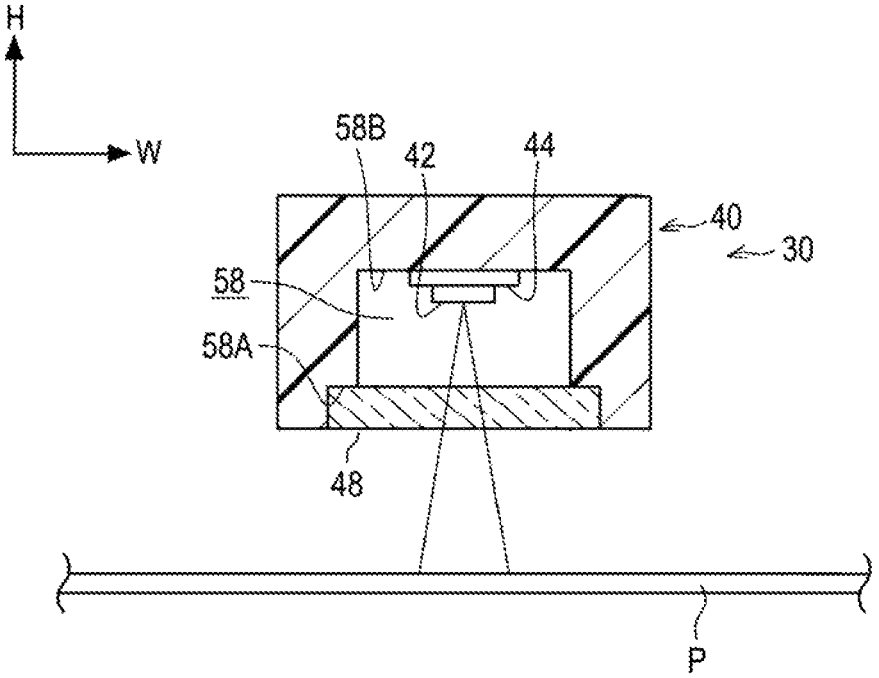
FIG. 6A is a sectional view of a drying unit of the droplets drying device according to the first exemplary embodiment.

As shown in FIGS. 5 and 6A, the drying unit 30 extends in the apparatus depth direction. The drying unit 30 is equipped with a body member 40, a board 44 which is mounted with light sources 42, and a protective member 48 which protects the light sources 42.

[Body Member 40]

The body member 40, which is shaped like a rectangular parallelepiped, extends in the apparatus depth direction and has a recess 58 that is open on the side of the continuous sheet P. The body member 40 is formed with a step portion 58A on the side of the continuous sheet P in such a manner that the width of the recess 58 is increased there. The protective member 48 is attached to the step portion 58A by a fixing member (not shown).

The board 44 is attached, by a fixing member (not shown), to a flat bottom surface 58B, facing the continuous sheet P, of the recess 58.

[Board 44]

The board 44 extends in the apparatus depth direction and, as mentioned above, attached to the bottom surface 58B of the recess 58.

The light sources 42 are mounted on the surface, facing the continuous sheet P, of the board 44. The plural light sources 42 are surface emission lasers (VCSELs) and are arranged at the same interval in the apparatus depth direction.

Figure 9:
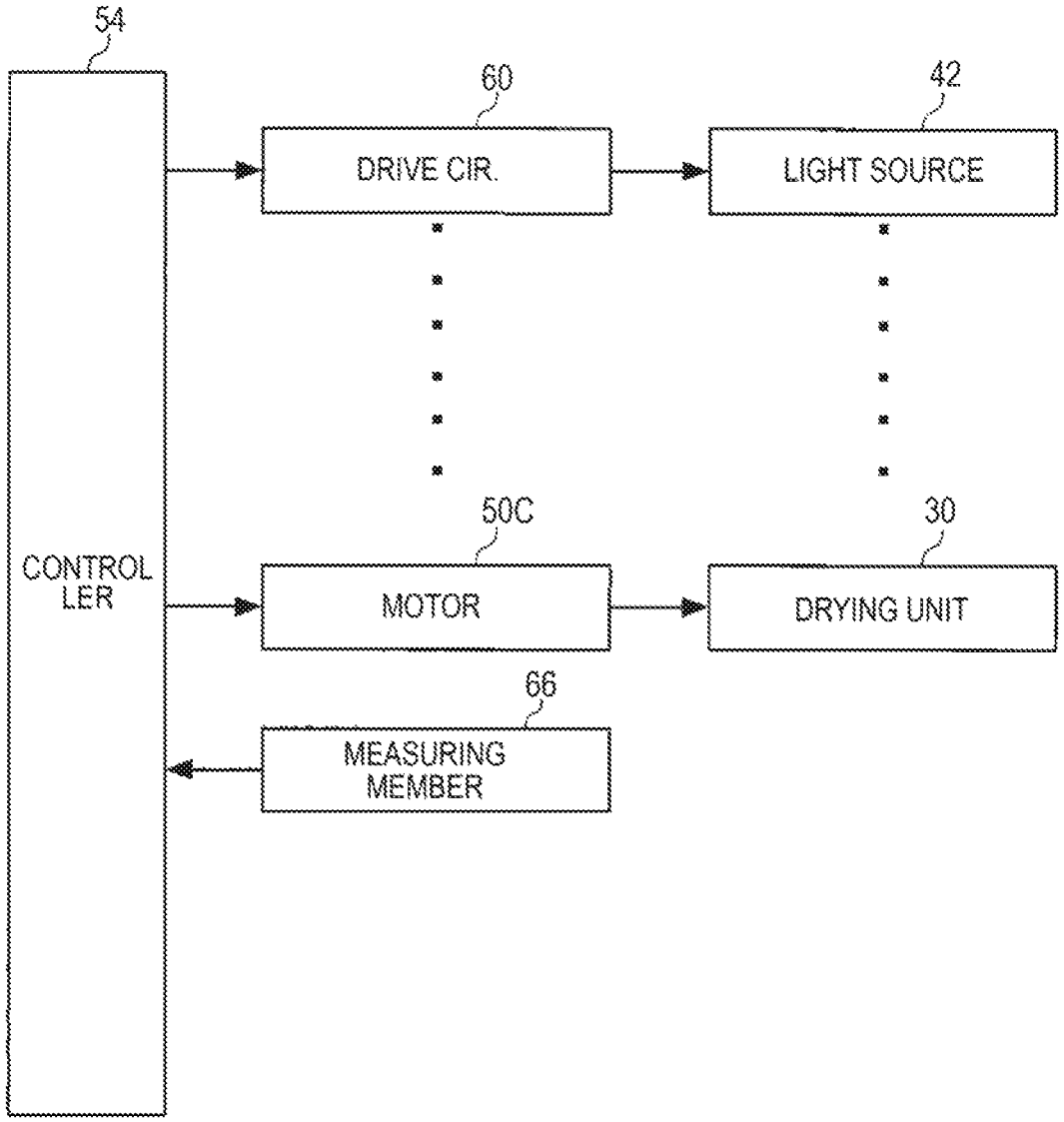
FIG. 9 shows a control system of the droplets drying devices according to the first exemplary embodiment.

As shown in FIG. 9, drive circuits 60 for controlling drive currents flowing through the respective light sources 42 are formed on the board 44 so as to correspond to the respective light sources 42. The controller 54 controls the light quantities of the light sources 42 by controlling the drive circuits 60. The timing etc. of the control of the drive circuits 60 by the controller 54 will be described later in detail together with the operation of the droplets drying device 28.

[Protective Member 48]

The protective member 48 is a heat-resistant glass plate, extends in the apparatus depth direction, and, as mentioned above, attached to the step portion 58A of the body member 40. The protective member 48 protects the light sources 42 and transmits light emitted from the light sources 42.

[Moving Mechanism 50]

As shown in FIG. 1, the moving mechanism 50 is equipped with a rail member 50A which extends in the apparatus depth direction, a support member 50B which supports the body member 40, and a motor 50C. The rail member 50A extends in the apparatus depth direction from over the continuous sheet P to the deep side (left side in FIG. 1).

The support member 50B connects the rail member 50A and the body member 40. A bottom portion of the support member 50B is attached to the body member 40, and its top portion is attached movably to the rail member 50A. The motor 50C moves the support member SOB in the apparatus depth direction along the rail member 50A.

Figure 8:
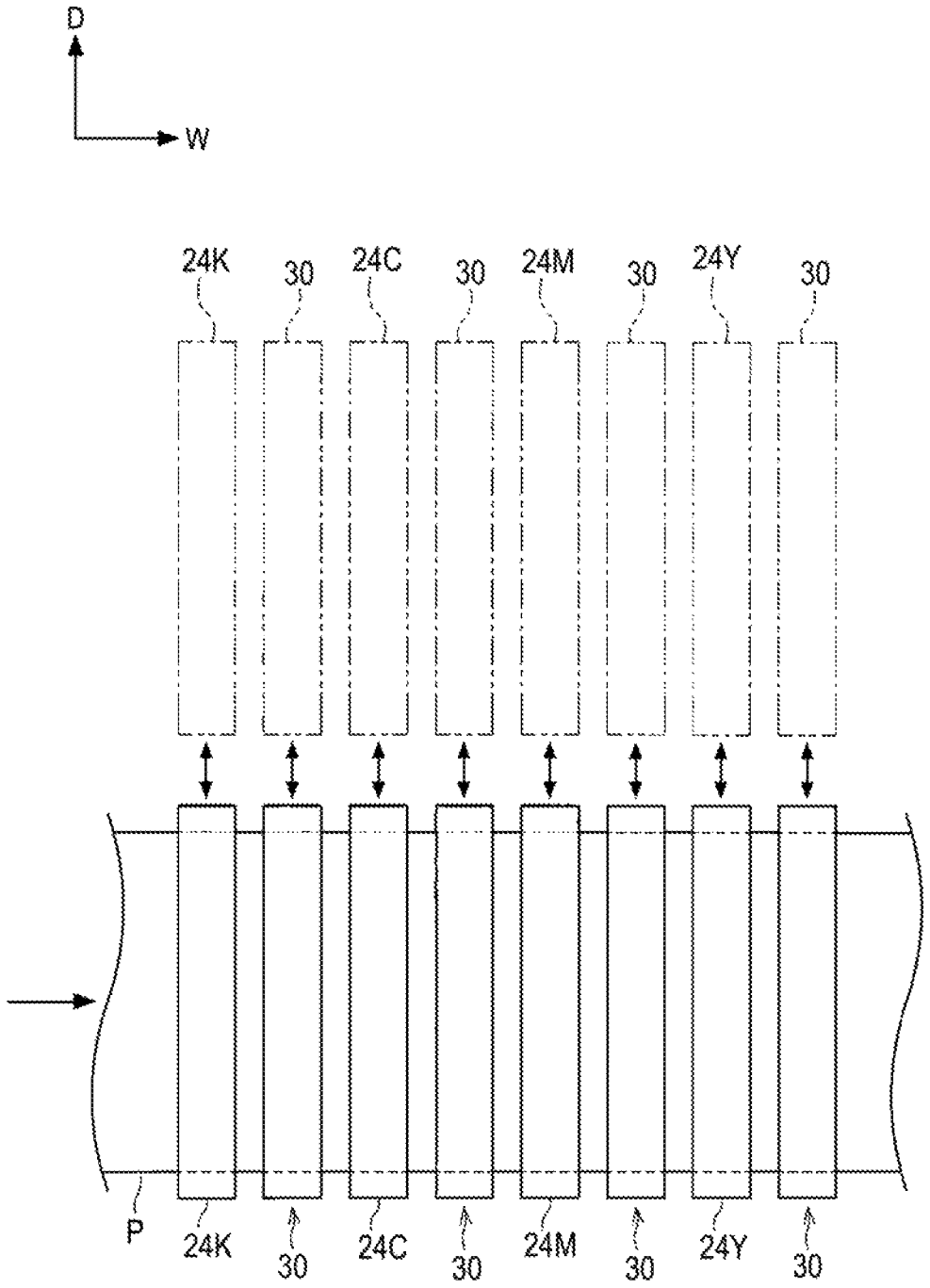
FIG. 8 is a plan view illustrating how the drying units of the droplets drying devices according to the first exemplary embodiment and droplets ejecting heads are moved.

With the above configuration, as shown in FIG. 8, the controller 54 moves the drying unit 30 between the drying position (drawn by solid lines) where it is opposed to the continuous sheet P and the escape position (drawn by two-dot chain lines) that deviates from the drying position to the deep side in the apparatus depth direction, by controlling the motor 50C. The timing etc. of the control of the motor 50C by the controller 54 will be described later in detail together with the operation of the droplets drying device 28.

A moving mechanism (not shown) for moving the droplets ejecting head 24 of each color is also attached to it, and the droplets ejecting head 24 of each color is also moved in the apparatus depth direction like each drying unit 30.

[Maintenance Unit 52]

Figure 2:
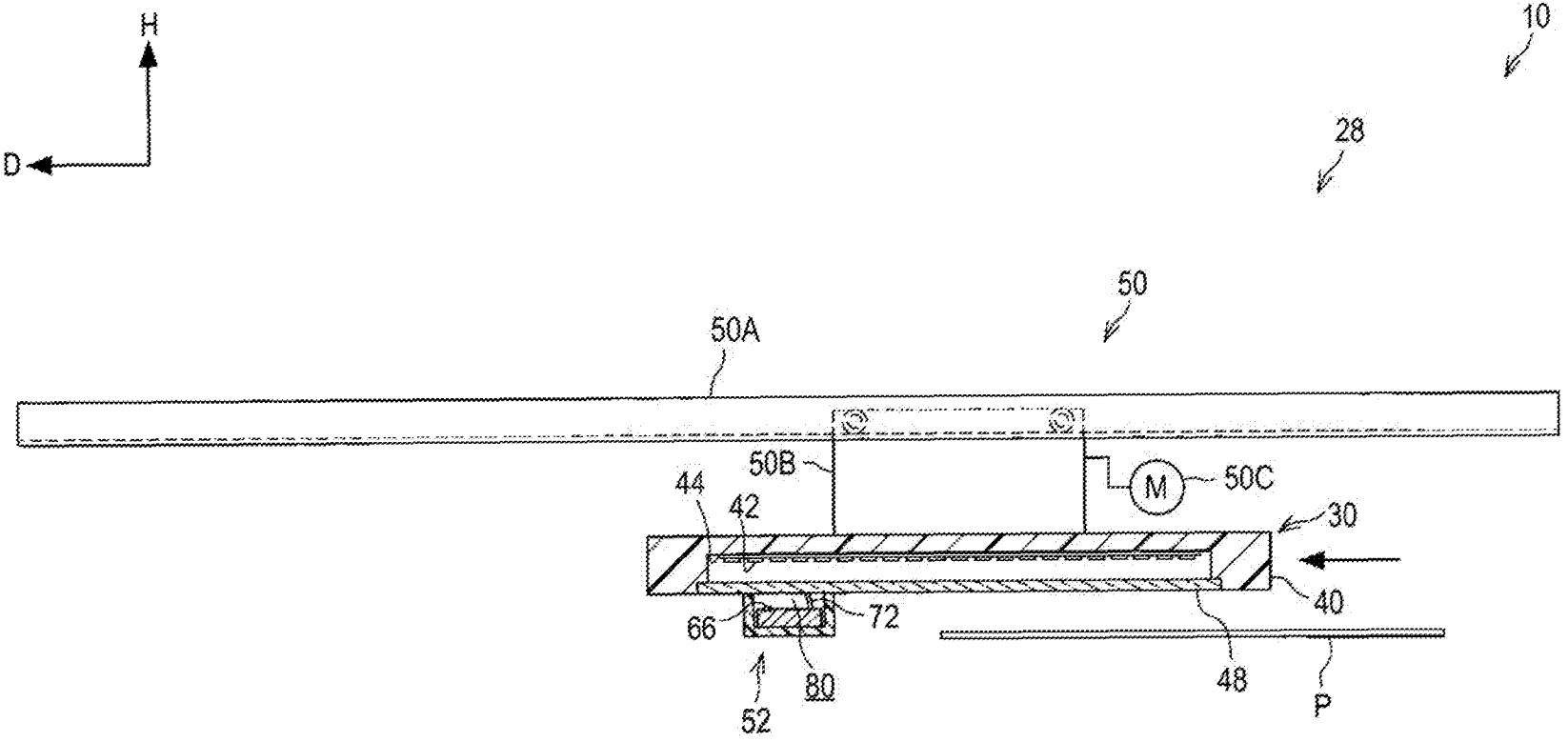
FIG. 2 is another sectional view of the droplets drying device according to the first exemplary embodiment.
Figure 3:
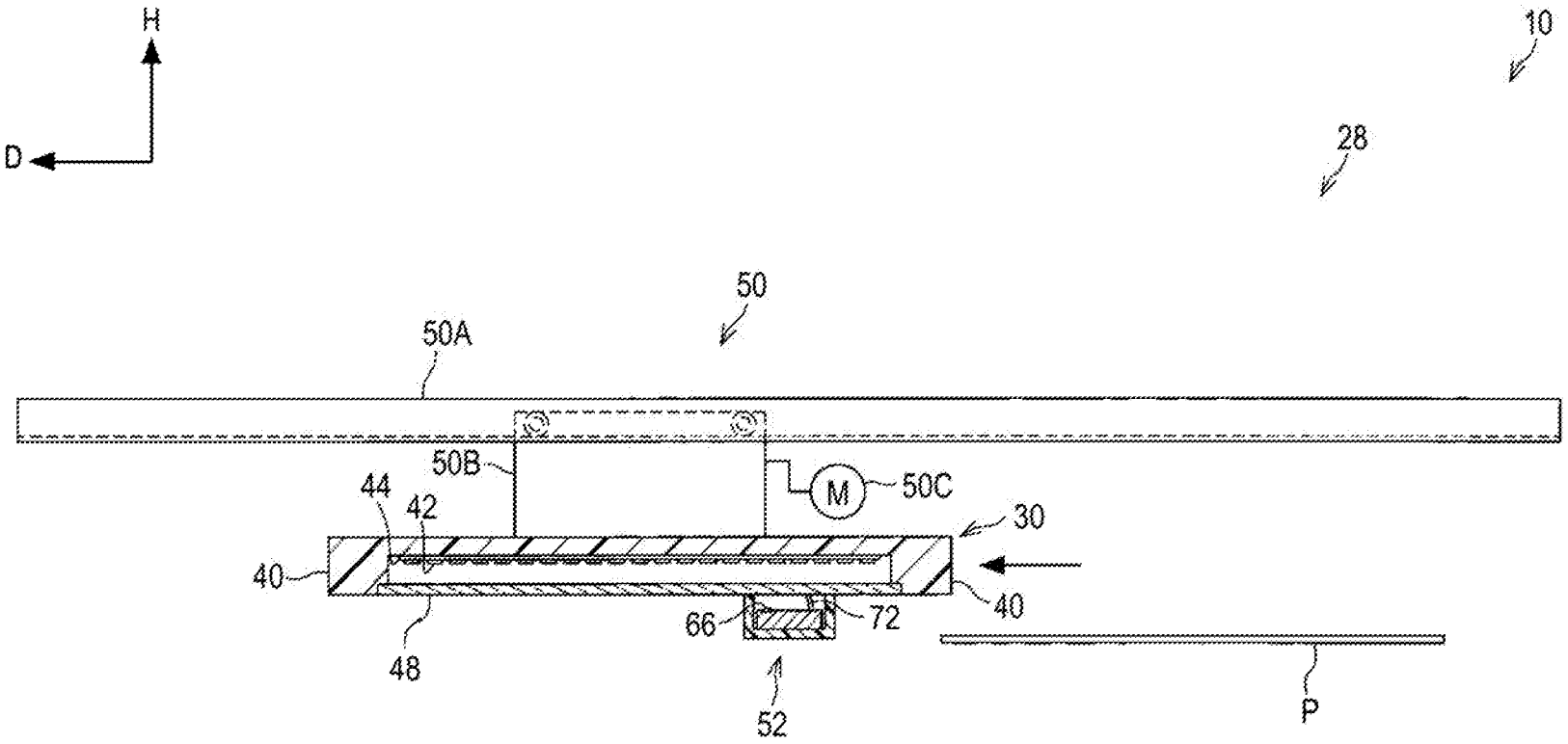
FIG. 3 is still another sectional view of the droplets drying device according to the first exemplary embodiment.
Figure 4:
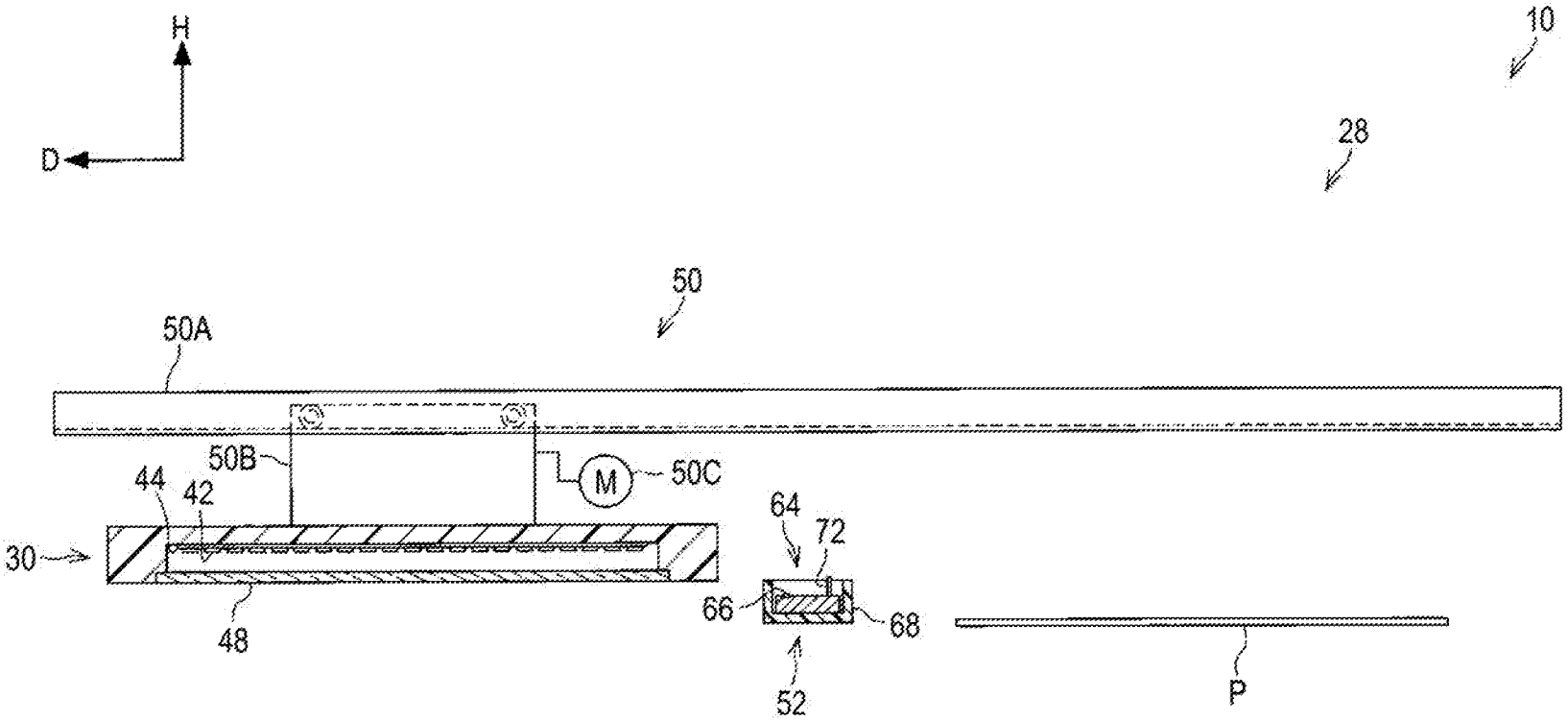
FIG. 4 is a further sectional view of the droplets drying device according to the first exemplary embodiment.

The maintenance unit 52 is spaced from the drying unit 30 in both of a case that the drying unit 30 is located at the drying position (see FIG. 1) and a case that the drying unit 30 is located at the escape position (see FIG. 4). As shown in FIGS. 2 and 3, the maintenance unit 52 is opposed to the drying unit 30 when the drying unit 30 is being moved between the drying position and the escape position.

As shown in FIG. 1, the maintenance unit 52 is equipped with a cleaning member 64, a measuring member 66 for measuring the light quantity of each light source 42, and a body 68 which is fixed to a frame (not shown; an example of an apparatus body).

[Body 68]

Figure 7:
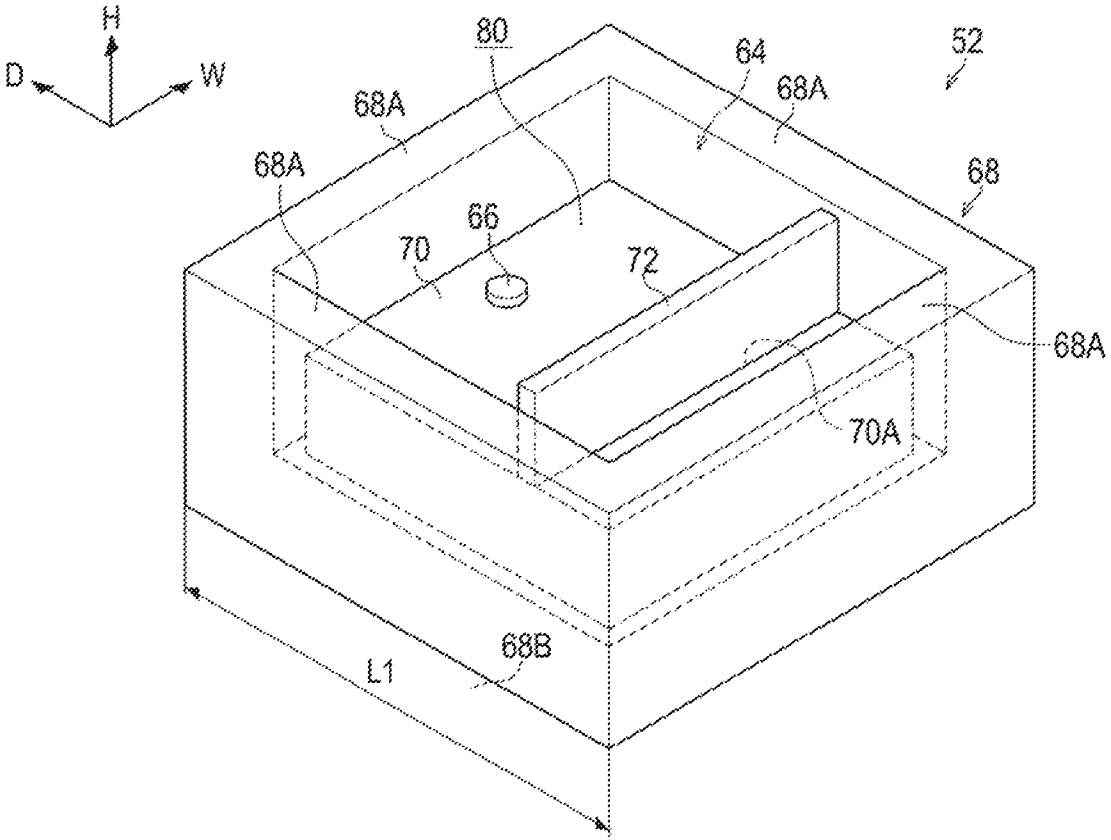
FIG. 7 is a perspective view of the maintenance unit of the droplets drying device according to the first exemplary embodiment.

As shown in FIG. 7, the body 68, which is an example light shield member, is shaped like a box having a top opening and is composed of four side plates 68A and a bottom plate 68B. The length L1 in the apparatus depth direction of the body 68 is shorter than the length in the apparatus depth direction of the drying unit 30. In other words, the body 68 has such a length as to be opposed to part of the plural light sources 42.

Figure 6B:
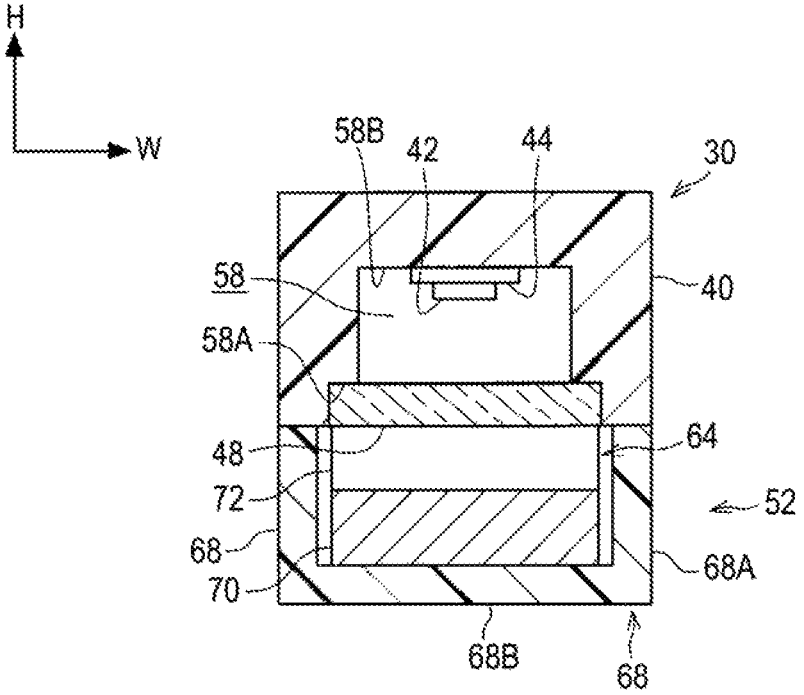
FIG. 6B is a sectional view of the drying unit and a maintenance unit of the droplets drying device according to the first exemplary embodiment.

As shown in FIGS. 2 and 6B, when the drying unit 30 is being moved between the drying position and the escape position, the bottom end portion of the drying unit 30 is brought in close proximity to the tips of the respective side plates 68A in the apparatus top-bottom direction. Light emitted from the light sources 42 opposed to the maintenance unit 52 is interrupted by the body 68. In the first exemplary embodiment, a region that is surrounded by the side plates 68A when viewed from above (from the side of the opening of the body 68) and where incoming light is thereby interrupted is referred to as a light shield region 80. Light that goes toward the light shield region 80 does not leak to the outside.

[Cleaning Member 64]

As shown in FIG. 1, the cleaning member 64 is disposed in the light shield region 80 and fixed to the body 68. As shown in FIG. 7, the cleaning member 64 is equipped with a rectangular-parallelepiped-shaped seat 70 and a plate-like blade 72 whose base portion is attached to the seat 70 and tip portion is to come into contact with the bottom surface of the protective member 48.

The seat 70 is formed with a slit 70A which extends in the apparatus width direction. A base portion of the blade 72 is fitted in the slit 70A.

The blade 72 is formed by molding, for example, a rubber material that is elastically deformable, and is oriented so that its thickness direction coincides with the apparatus depth direction. As shown in FIGS. 2 and 3, the tip portion of the blade 72 comes into contact with the protective member 48 of the drying unit 30 when the drying unit 30 is being moved between the drying position and the escape position.

[Measuring Member 66]

As shown in FIGS. 1 and 7, the measuring member 66 is disposed in the light shield region 80. As shown in FIG. 7, the measuring member 66 is fixed to the top surface of the seat 70 on the deep side of the blade 72 in the apparatus depth direction.

The measuring member 66 measures the light quantity of each light source 42. The controller 54 receives measurement results, for the respective light sources 42, of the measuring member 66 (see FIG. 9) and corrects their light quantities. Thus, the controller 54 serves as an example correction unit for correcting the light quantity of each light source 42. How the controller 54 controls the individual units when receiving measurement results of the measuring member 66 will be described below in detail together with the operation of the droplets drying device 28.

(Operation)

Next, a description will be made of how the droplets drying devices 28 operate. As shown in FIGS. 1 and 5, while the image forming apparatus 10 is not in operation, the drying units 30 are located at the drying positions and the sets of light sources 42 are off. When the image forming apparatus 10 is put into operation and an image forming operation is started, the droplets ejecting heads 24 of the respective colors eject droplets onto a portion of the continuous sheet P being conveyed and form an image there.

When droplets are ejected onto the portion of the continuous sheet P by the droplets ejecting heads 24, the controller 54 controls the sets of drive circuits 60 to cause the sets of light sources 42 to emit light (see FIG. 6A), whereby droplets ejected onto the portion of the continuous sheet P are irradiated with light and dried (through evaporation).

Upon completion of an image forming operation of one job (i.e., one continuous image forming operation), the ejecting of droplets by the droplets ejecting heads 24 is stopped and the controller 54 controls the sets of drive circuits 60 to turn off the sets of light sources 42.

When the sets of light sources 42 have been turned off, the controller 54 controls the motor 56C to move the drying units 30 from the drying positions to the escape positions. More specifically, as shown in FIGS. 2 and 3, each drying unit 30 is moved in a state that the bottom surface of the protective member 48 is in contact with the tip portion of the blade 72. As a result, foreign matter such as colorant that is stuck to the bottom surface of the protective member 48 is wiped out by the blade 72, that is, the protective member 48 is cleaned. Thus, a measurement by the measuring member 66 is made more correct than in a case that no cleaning is performed before a measurement.

The controller 54 controls the drive circuits 60 to turn on the light sources 42 in order that come to be opposed to the measuring member 66 with a portion, from which foreign matter has been wiped out, of the protective member 48 interposed between them. More specifically, the controller 54 causes each light source 42 to emit light while the light emitted from it is interrupted by the body 68. The measuring member 66 receives light emitted from the light source 42 and measures its light quantity.

As shown in FIGS. 2 and 3, as each drying unit 30 is moved to the escape position, the blade 72 cleans the entire bottom surface of the protective member 48 and the measuring member 66 measures the light quantities of all of the light sources 42. Upon measuring the light quantities of all of the light sources 42, the controller 54 receives measurement results of the measuring member 66 and controls the drive circuits 60 to correct the values of drive currents for the respective light sources 42. More specifically, the controller 54 corrects the values of drive currents for the respective light sources 42 so that they fall within a predetermined range. In other words, the controller 54 corrects the light quantities of the respective light sources 42 so that they fall within a predetermined range.

Upon correcting the values of drive currents, the controller 54 controls the motor 50C to move the drying unit 30 from the escape position to the drying position. As soon as the drying unit 30 reaches the drying position, the controller 54 controls the motor 50C to move the drying unit 30 to the escape position again (see FIGS. 1-4).

The controller 54 controls the drive circuits 60 to cause the light sources 42 that come to be opposed to the measuring member 66 to emit light in order. The measuring member 66 again receives light emitted from each light source 42 and measures its light quantity. During the above course, as in the case of the first movement, the blade 72 comes into contact with the bottom surface of the protective member 48 of the drying unit 30.

When the drying unit 30 has reached the escape position (see FIG. 4), the measuring member 66 has measured the light quantities of all of the light sources 42. The controller 54 receives measurement results of the measuring member 66 and checks whether or not the light quantities of all of the light sources 42 are within the predetermined range.

Upon receiving the measurement results of the measuring member 66, the controller 54 controls the motor 50C to move the drying unit 30 from the escape position to the drying position. When the drying unit 30 has been moved to the drying position, the droplets drying device 28 makes preparations for the next image forming operation.

(Summary)

As described above, the measuring member 66 is disposed in the light shield region 80. With this measure, the degree of leakage, to outside the body 68 (outside the light shield region 80), of light to be measured by the measuring member 66 is made lower than in a case that a measuring member is not disposed in the light shield region 80.

The cleaning member 64 and the measuring member 66 are disposed in the light shield region 80. With this measure, the degree of size increase of each droplets drying device 28 is made lower than in a case that a cleaning member and a measuring member are disposed in different regions.

In each droplets drying device 28, the cleaning member 64 cleans the protective member 48 and the measuring member 66 measures the light quantities of the respective light sources 42 as the drying unit 30 is moved. With this measure, the power consumption can be made lower than in, for example, a case that the protective member 48 is cleaned and the light quantities of the light sources 42 are measured as both of a drying unit and a maintenance unit are moved.

In each droplets drying device 28, the body 68 has such a size as to be opposed to part of the plural light sources 42. With this measure, the degree of size increase of the droplets drying device 28 is made lower than in a case that a body has such a size as to be opposed to all light sources.

In each droplets drying device 28, the controller 54 corrects the light quantities of the light sources 42 on the basis of measurement results of the measuring member 66. As a result, the probability that the light quantities of the light sources 42 deviate from the predetermined range can be made lower than in a case that the light quantities of the light sources 42 are not corrected.

In each droplets drying device 28, the measuring member 66 measures the light quantities of the light sources 42 again by receiving light beams emitted from the light-quantity-corrected light sources 42. This allows the controller 54 to check whether or not the corrected light quantities of the light sources 42 are within the predetermined range.

According to the image forming apparatus 10, its inside space can be utilized effectively because it is equipped with the droplets drying devices 28.

Exemplary Embodiment 2

Droplets drying devices 128 and an image forming apparatus according to a second exemplary embodiment of the invention will be described below with reference to FIGS. 11-14. In the second exemplary embodiment, differences from the first exemplary embodiment will be described mainly.

Figure 11:
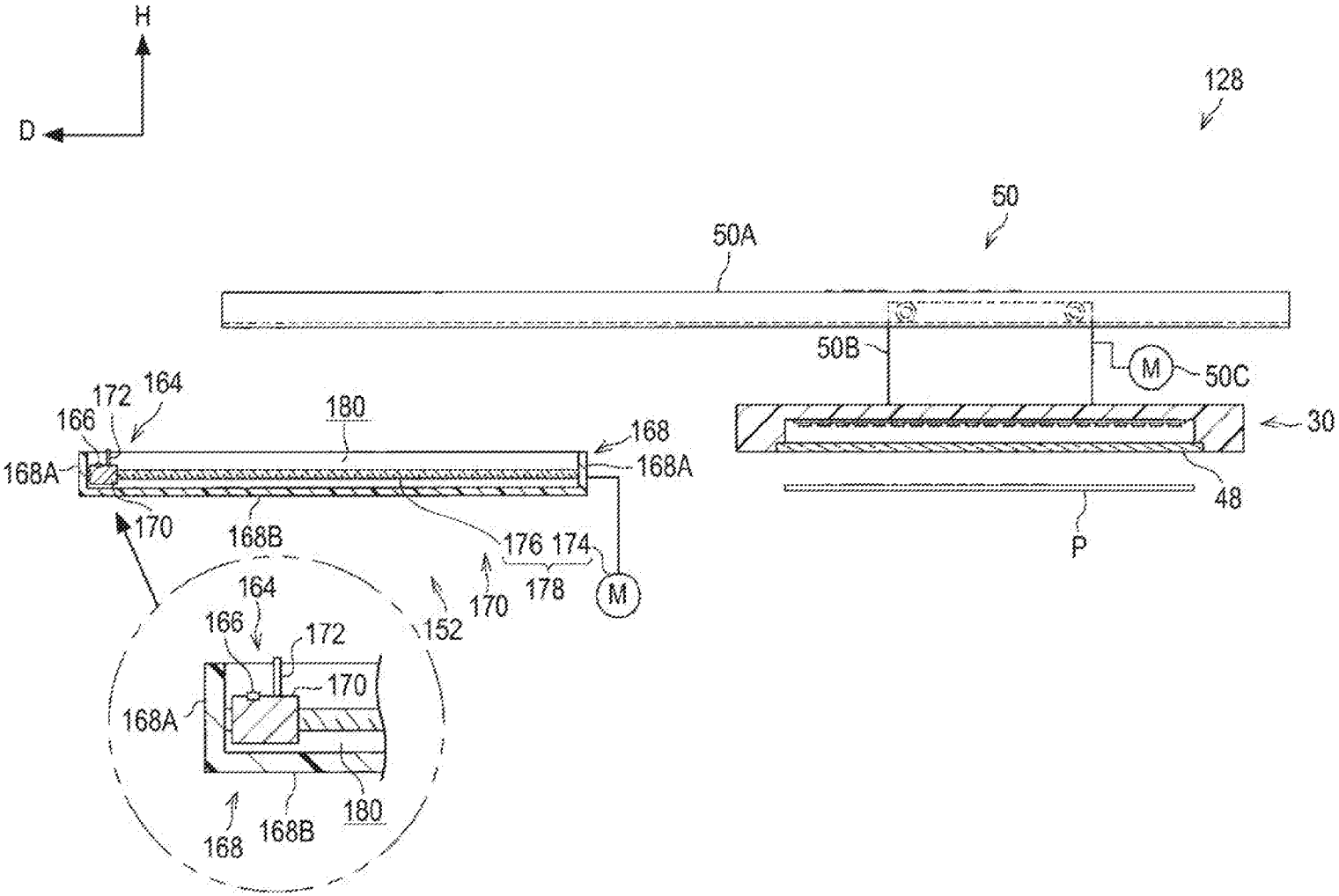
FIG. 11 is a sectional view of a droplets drying device according to a second exemplary embodiment of the invention.
Figure 12:
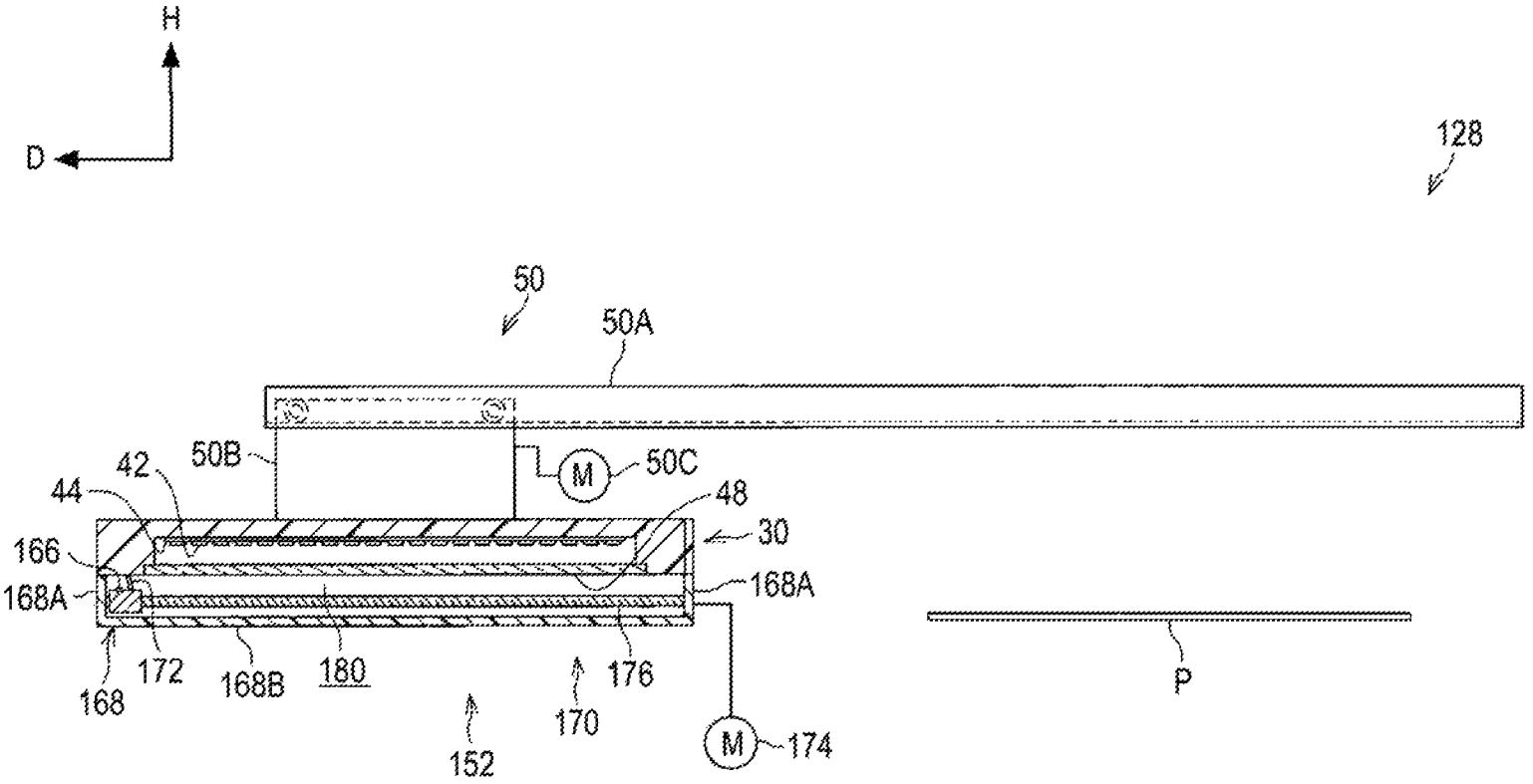
FIG. 12 is another sectional view of the droplets drying device according to the second exemplary embodiment.
Figure 14:
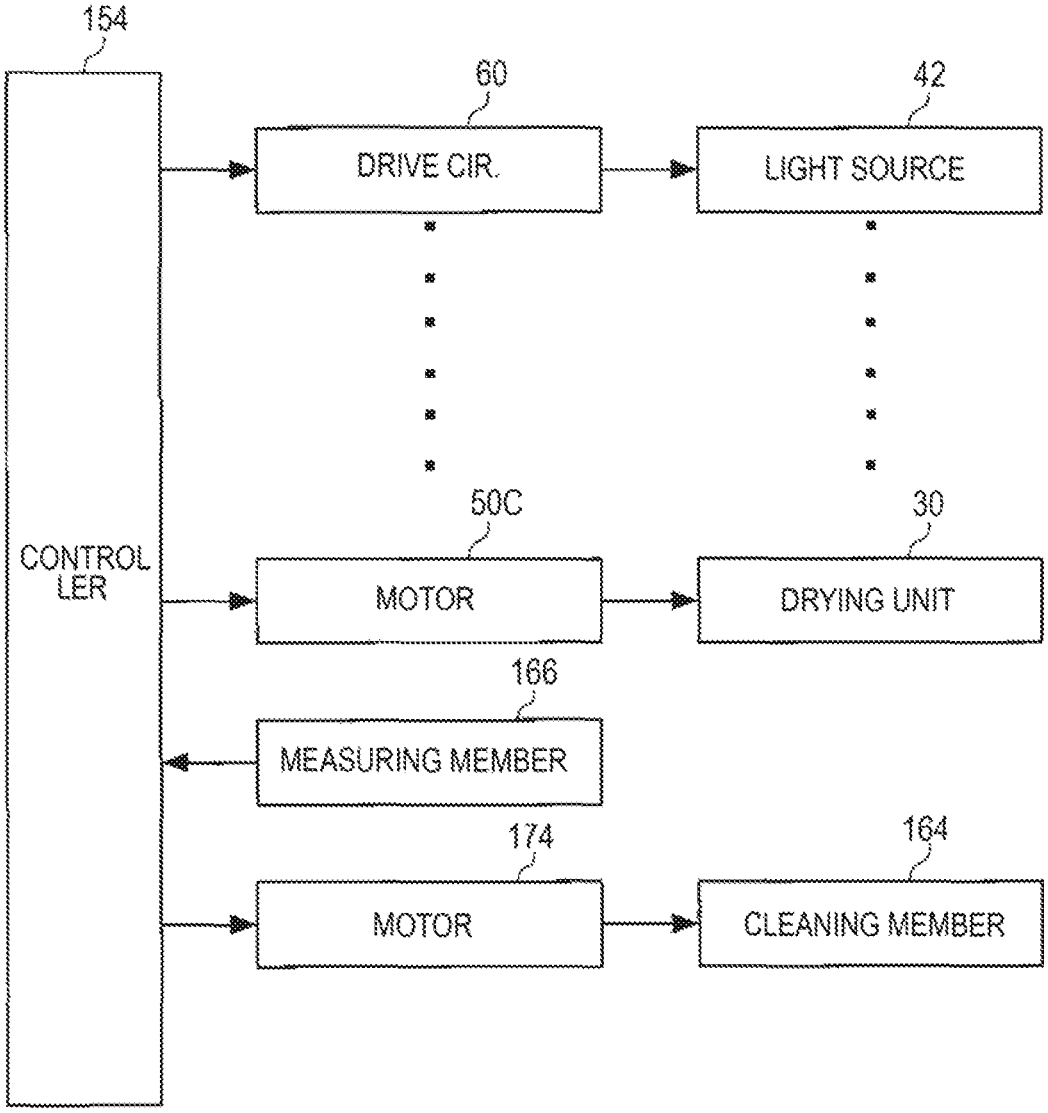
FIG. 14 shows a control system of the droplets drying devices according to the second exemplary embodiment.

As shown in FIGS. 11 and 12, each droplets drying device 128 is equipped with a drying unit 30, a moving mechanism 50, a maintenance unit 152 to be opposed to the drying unit 30 located at the escape position, and a controller 54 (see FIG. 14).

[Maintenance Unit 152]

The maintenance unit 152 is equipped with a cleaning member 164 for cleaning the protective member 48, a measuring member 166 for measuring the light quantity of each light source 42, a body 168, and a moving mechanism 178 for moving the cleaning member 164.

[Body 168]

The body 168, which is an example light shield member, is shaped like a box extending in the apparatus depth direction and having a top opening and is composed of four side plates 168A and a bottom plate 168B.

As shown in FIG. 12, when the drying unit 30 is located at the escape position, the tips of the respective side plates 168A are in close proximity to the bottom end portion of the drying unit 30 and the side plates 168A surround the protective member 48 when viewed from above. Light emitted from the light sources 42 of the drying unit 30 located at the escape position is interrupted by the body 168. A region that is surrounded by the side plates 168A when viewed from above (from the side of the opening of the body 168) and where incoming light is thereby interrupted is referred to as a light shield region 180. Light that goes toward the light shield region 180 does not leak to the outside.

[Cleaning Member 164]

As shown in FIGS. 11 and 12, the cleaning member 164 is disposed in the light shield region 180 and equipped with a rectangular-parallelepiped-shaped seat 170 and a plate-like blade 172 whose base portion is attached to the seat 170 and tip portion is to come into contact with the bottom surface of the protective member 48.

The seat 170 is formed with a slit 70A (not shown) which extends in the apparatus width direction. A base portion of the blade 172 is fitted in the slit 170A.

Figure 13A:
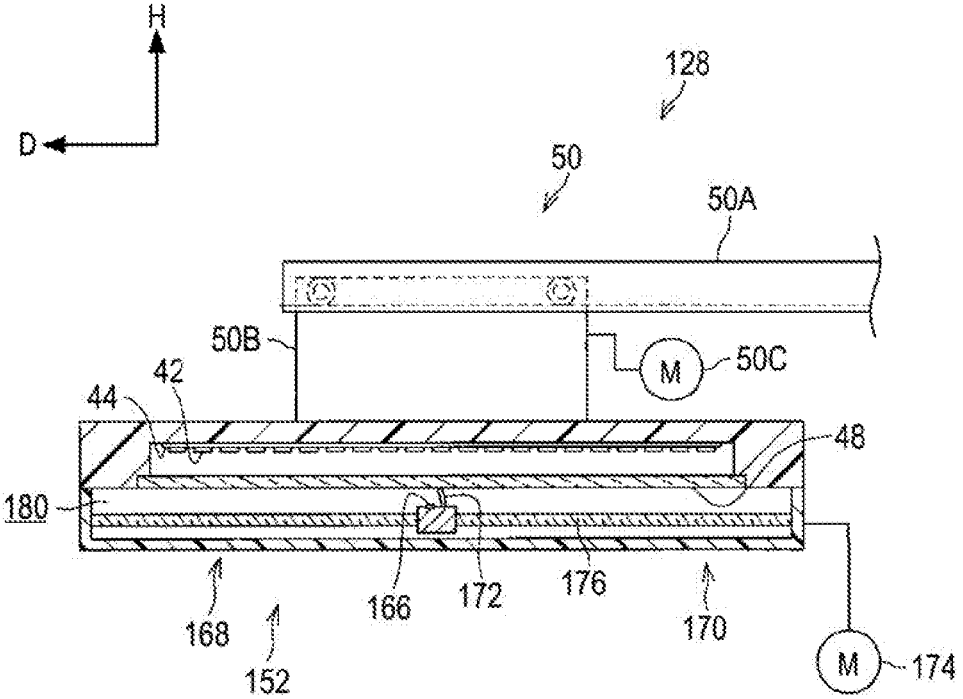
FIGS. 13A and 13B are further sectional views of the droplets drying device according to the second exemplary embodiment.

The blade 172 is formed by molding, for example, a rubber material that is elastically deformable. As shown in FIG. 13A, a tip portion of the blade 172 comes into contact with the protective member 48 of the drying unit 30 by moving the cleaning member 164 by the moving mechanism 178.

[Measuring Member 166]

As shown in FIG. 11, the measuring member 166 is disposed in the light shield region 180 and fixed to the top surface of the seat 170 on the deep side of the blade 172 in the apparatus depth direction. The measuring member 166 measures the light quantities of the light source 42 in order that come to be opposed to the measuring member 166 by moving the cleaning member 164 by the moving mechanism 178 as shown in FIG. 13A.

[Moving Mechanism 178]

As shown in FIG. 11, the moving mechanism 178 is equipped with a ball screw 176 which extends in the apparatus depth direction and penetrates through the seat 170 and a motor 174 for rotating the ball screw 176. The ball screw 176 is rotated in a normal direction or a reverse direction by the controller 154's controlling the motor 174. As a result, the cleaning member 164 is moved between a cleaning start position (see FIG. 12) where cleaning of the protective member 48 is started and a cleaning end position (see FIG. 13B) where cleaning of the protective member 48 is finished.

(Operation)

Next, a description will be made of how the droplets drying devices 128 operate. As shown in FIG. 11, while the image forming apparatus is not in operation, the drying units 30 are located at the drying positions and the cleaning members 164 are located at the cleaning start positions. When the image forming apparatus is put into operation and an image forming operation is started, the droplets ejecting heads 24 of the respective colors eject droplets onto a portion of the continuous sheet P being conveyed and form an image there.

Upon completion of an image forming operation of one job (i.e., one continuous image forming operation), the ejecting of droplets by the droplets ejecting heads 24 is stopped and the controller 154 controls the sets of drive circuits 60 to turn off the sets of light sources 142.

When the sets of light sources 42 have been turned off, the controller 154 controls the motor 56C to move the drying units 30 from the drying positions to the escape positions (see FIGS. 11 and 12). At the escape positions, the drying units 30 are opposed to the respective maintenance units 152.

Figure 13B:
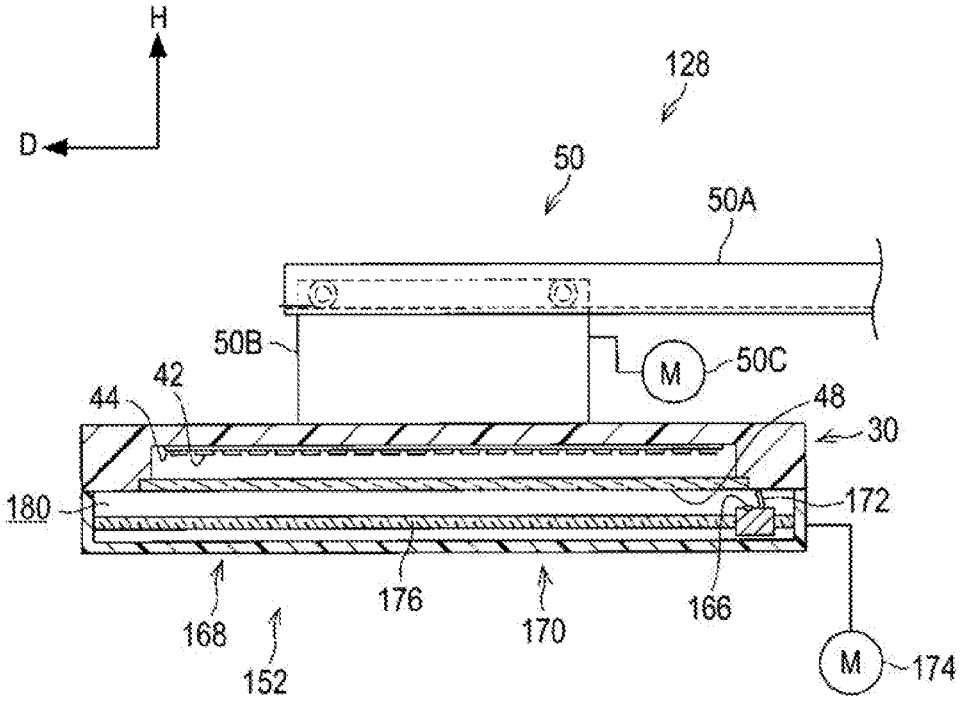

In the state that each drying unit 30 is opposed to the corresponding maintenance unit 152, the controller 154 controls the motor 174 to move the cleaning member 164 from the cleaning start position to the cleaning end position. As shown in FIGS. 13A and 13B, as cleaning member 164 is moved, the tip portion of the blade 172 is kept in contact with the bottom surface of the protective member 48, whereby foreign matter such as colorant that is stuck to the bottom surface of the protective member 48 is wiped out by the blade 172.

The controller 154 then controls the drive circuits 60 to turn on the light sources 42 in order that come to be opposed to the measuring member 166 with a portion, from which foreign matter has been wiped out, of the protective member 48 interposed between them. The measuring member 166 receives light emitted from each light source 42 and measures its light quantity.

As shown in FIG. 13B, as the cleaning member 164 is moved to the cleaning end position, the blade 172 cleans the entire bottom surface of the protective member 48 and the measuring member 166 measures the light quantities of all of the light sources 42. Upon measuring the light quantities of all of the light sources 42, the controller 154 receives measurement results of the measuring member 166 and controls the drive circuits 60 to correct the values of drive currents for the respective light sources 42. More specifically, the controller 154 corrects the values of drive currents for the respective light sources 42 so that they fall within a predetermined range. In other words, the controller 154 corrects the light quantities of the respective light sources 42 so that they fall within a predetermined range.

Upon correcting the values of drive currents, the controller 154 controls the motor 174 to move the cleaning member 164 from the cleaning end position to the cleaning start position. As soon as the cleaning member 164 reaches the cleaning start position, the controller 154 controls the motor 174 to move the drying unit 30 to the cleaning end position again (see FIGS. 13A and 13B).

The controller 54 controls the drive circuits 60 to cause the light sources 42 that come to be opposed to the measuring member 166 to emit light in order. The measuring member 166 again receives light emitted from each light source 42 and measures its light quantity. During the above course, as in the case of the first movement, the blade 172 comes into contact with the bottom surface of the protective member 48 of the drying unit 30.

When the cleaning member 164 has reached the cleaning end position (see FIG. 13B), the measuring member 166 has measured the light quantities of all of the light sources 42. The controller 154 receives measurement results of the measuring member 166 and checks whether or not the light quantities of all of the light sources 42 are within the predetermined range.

Subsequently, the controller 154 controls the motor 174 to move the cleaning member 164 from the cleaning end position to the cleaning start position and controls the motor 50C to move the drying unit 30 from the escape position to the drying position. When the drying unit 30 has been moved to the drying position, the droplets drying device 128 makes preparations for the next image forming operation.

The droplets drying device 128 according to the second exemplary embodiment operates in the same manner as the droplets drying device 28 according to the first exemplary embodiment except that the protective member 48 is cleaned and the light quantities of the light sources 42 are measured as the cleaning member 164 is moved, and that the body 168 has such a size as to be opposed to all of the light sources 42.

Although the invention has been described in detail in the form of the particular embodiments, it is apparent to those skilled in the art that various changes and modifications are possible without departing from the spirit and scope of the invention. For example, although in the above exemplary embodiments the maintenance timing of the drying units 30 is after completion of one job, it may be some other timing.

Figure 15:
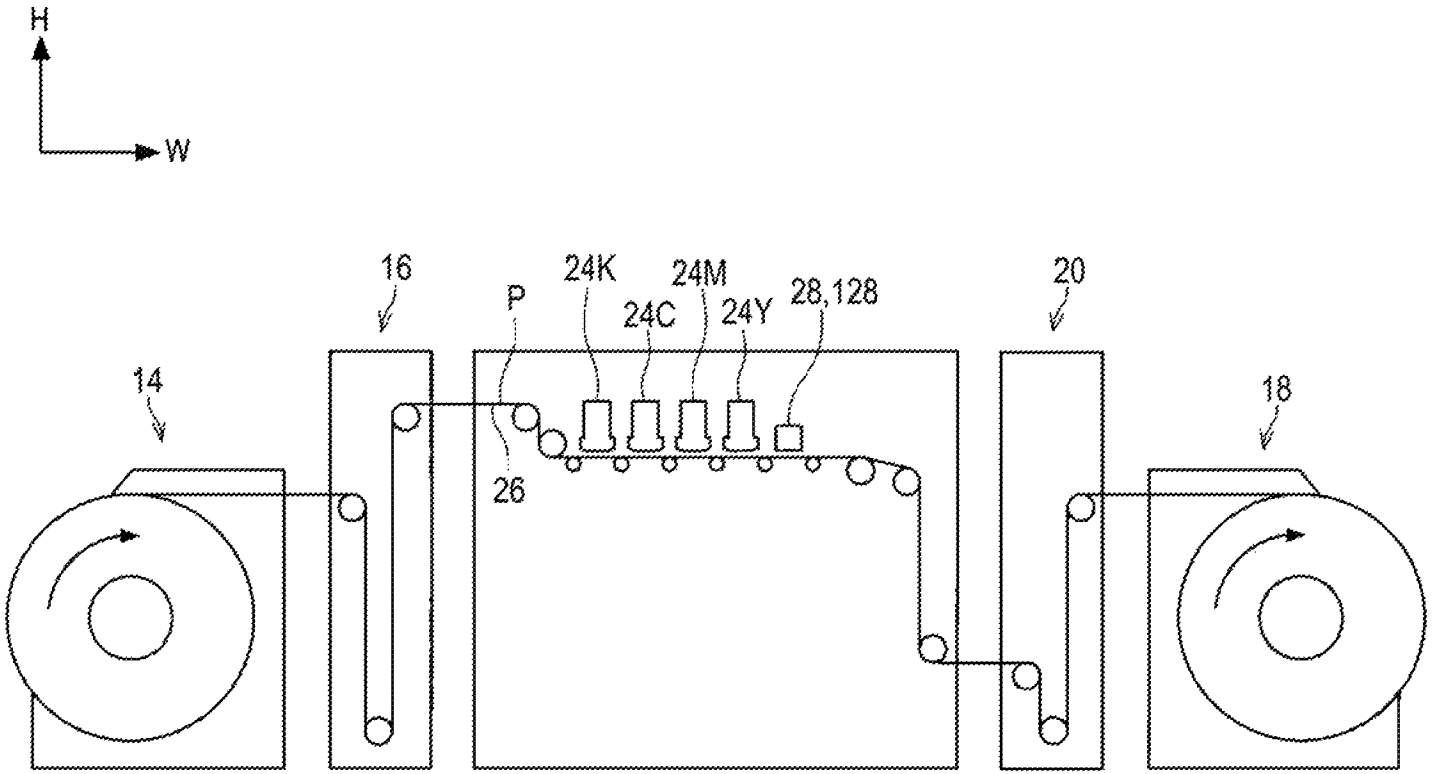
FIG. 15 is a schematic diagram showing the configuration of an image forming apparatus according to a modification of the first or second exemplary embodiment.

Although in the above exemplary embodiments each droplets drying device 28 or 128 is disposed downstream of the associated droplets ejecting head 24 of one color in the sheet feeding direction, as shown in FIG. 15 only one droplets drying device 28 or 128 may be disposed downstream of the droplets ejecting head 24Y which is disposed most downstream in the sheet feeding direction.

Although in the above exemplary embodiments all of the light sources 42 are turned on in order when their light quantities are measured again after their correction, only light-quantity-corrected light sources 42 may be caused to emit light.

Although in the second exemplary embodiment the cleaning member 164 is disposed inside the body 168 which is the light shield member, the cleaning member 164 may be disposed outside the body 168.

Although in the second exemplary embodiment the measuring member 166 is attached to the seat 170 of the cleaning member 164, a measuring member and a cleaning member may be provided separately. In this case, the measuring member and the cleaning member may be moved separately.

What is claimed is:

1. A droplets drying device comprising:

a drying mechanism having a plurality of light sources that are arranged in a width direction of a recording medium, and dry droplets ejected onto the recording medium by emitting light toward the droplets;

a moving mechanism that moves the drying mechanism in the width direction;

a light shield member that is opposed to at least part of the drying mechanism being moved by the moving mechanism, and interrupts light emitted from the light sources disposed in the part, opposed to the light shield member, of the drying mechanism, the light shield member having a box-like shape including a bottom plate, four side plates, and a top opening; and a measuring member that is disposed in a light shield region where the light shield member interrupts incoming light, the light shield region being surrounded by the side plates of the light shield member when viewed from above, and the measuring member receiving light emitted from each of the light sources and measuring a light quantity of the light source as the measuring member is moved relative to the drying mechanism in the width direction.

2. The droplets drying device according to claim 1, wherein:

the drying mechanism further has a protective member that can transmit light and protects the light sources;

the droplets drying device further comprises a cleaning member that cleans the protective member during relative movement between the cleaning member and the drying mechanism in the width direction; and the measuring member receives light emitted from each of the light sources and transmitted by a portion, cleaned by the cleaning member, of the protective member, and measures a light quantity of the light source.

3. The droplets drying device according to claim 2, wherein:

the light shield member, the cleaning member, and the measuring member are fixed to a device body; and the cleaning member cleans the protective member and the measuring member measures the light quantity of each of the light sources as the drying mechanism is moved in the width direction.

4. The droplets drying device according to claim 3, wherein the light shield member has such a size as to be opposed to part of the plurality of light sources.

5. The droplets drying device according to claim 4, further comprising a correction unit that corrects the light quantities of the light sources on the basis of measurement results of the measuring member, respectively.

6. The droplets drying device according to claim 5, wherein the measuring member receives light emitted from each of the light sources whose light quantities have been corrected by the correction unit, and measures a light quantity of the light source as the measuring member is moved relative to the drying mechanism in the width direction.

7. The droplets drying device according to claim 3, further comprising a correction unit that corrects the light quantities of the light sources on the basis of measurement results of the measuring member, respectively.

8. The droplets drying device according to claim 7, wherein the measuring member receives light emitted from each of the light sources whose light quantities have been corrected by the correction unit, and measures a light quantity of the light source as the measuring member is moved relative to the drying mechanism in the width direction.

9. The droplets drying device according to claim 2, wherein the light shield member has such a size as to be opposed to part of the plurality of light sources.

10. The droplets drying device according to claim 9, further comprising a correction unit that corrects the light quantities of the light sources on the basis of measurement results of the measuring member, respectively.

11. The droplets drying device according to claim 10, wherein the measuring member receives light emitted from each of the light sources whose light quantities have been corrected by the correction unit, and measures a light quantity of the light source as the measuring member is moved relative to the drying mechanism in the width direction.

12. The droplets drying device according to claim 2, further comprising a correction unit that corrects the light quantities of the light sources on the basis of measurement results of the measuring member, respectively.

13. The droplets drying device according to claim 12, wherein the measuring member receives light emitted from each of the light sources whose light quantities have been corrected by the correction unit, and measures a light quantity of the light source as the measuring member is moved relative to the drying mechanism in the width direction.

14. The droplets drying device according to claim 1, wherein the light shield member has such a size as to be opposed to part of the plurality of light sources.

15. The droplets drying device according to claim 14, further comprising a correction unit that corrects the light quantities of the light sources on the basis of measurement results of the measuring member, respectively.

16. The droplets drying device according to claim 15, wherein the measuring member receives light emitted from each of the light sources whose light quantities have been corrected by the correction unit, and measures a light quantity of the light source as the measuring member is moved relative to the drying mechanism in the width direction.

17. The droplets drying device according to claim 1, further comprising a correction unit that corrects the light quantities of the light sources on the basis of measurement results of the measuring member, respectively.

18. The droplets drying device according to claim 17, wherein the measuring member receives light emitted from each of the light sources whose light quantities have been corrected by the correction unit, and measures a light quantity of the light source as the measuring member is moved relative to the drying mechanism in the width direction.

19. An image forming apparatus comprising:

a droplets ejecting member that forms an image by ejecting droplets onto a recording medium; and the droplets drying device according to claim 1 that comprises the plurality of light sources that dry the droplets ejected onto the recording medium by the droplets ejecting member by emitting light toward the droplets.

* * * * *